US005244263A

United States Patent [19]

Kennedy

[11] Patent Number: 5,244,263

[45] Date of Patent: Sep. 14, 1993

[54] CONTINUOUS TOWEL CABINETS

[75] Inventor: James W. Kennedy, Buxted, England

[73] Assignee: David Kennedy (Engineers) Holdings Limited, Brookside, England

[21] Appl. No.: 674,397

[22] Filed: Mar. 25, 1991

[30] Foreign Application Priority Data

Apr. 3, 1990 [GB] United Kingdom ..... 9007480

[51] Int. Cl.[5] ..... B65H 19/00

[52] U.S. Cl. ..... 312/34.11; 312/34.12; 312/34.13; 226/131

[58] Field of Search ..... 312/34.8, 34.9, 34.11, 312/34.12, 34.13, 34.16, 34.17; 226/24, 127, 129, 131; 150/154

[56] References Cited

U.S. PATENT DOCUMENTS

| | | | |
|---|---|---|---|
| 2,140,440 | 12/1938 | Chidsey, Jr. | 312/38 |
| 3,502,383 | 3/1970 | Steiner et al. | 312/38 |
| 4,746,907 | 5/1988 | Zehnder, Jr. | 312/38 X |
| 4,957,246 | 9/1990 | Kantor | 150/154 X |

FOREIGN PATENT DOCUMENTS

| | | | |
|---|---|---|---|
| 841108 | 7/1960 | United Kingdom . | |
| 2203725 | 10/1988 | United Kingdom | 312/38 |

*Primary Examiner*—Kenneth J. Dorner
*Assistant Examiner*—Brian K. Green
*Attorney, Agent, or Firm*—Beveridge, DeGrandi, Weilacher & Young

[57] ABSTRACT

A continuous towel cabinet comprises a compartment for a roll of clean towel, and an arrangement of rollers for repeatedly allowing a length of clean towel to be dispensed into a loop beneath the cabinet and for simultaneously rewinding an equivalent length of soiled towel onto a rewind roller. The clean towel compartment is disposed above the arrangement of rollers and has at least a flexible base wall whereby the roll of soiled towel can reduce the depth of the clean towel compartment as the roll of soiled towel increases during operation of the towel cabinet. The clean towel compartment is preferably a flexible bag which is detachable from the cabinet. The pressure roller of the roller arrangement is also preferably mounted on the cover of the cabinet. The arrangement may also allow back rotation of the front metering roller with respect to the rewind roller.

15 Claims, 6 Drawing Sheets

8
95
91
94
96
53
52
90
88
89
87
86
93
85
92
8

9
9
53
52
96
88
89
87
86
93
92

CONTINUOUS TOWEL CABINETS

BACKGROUND OF THE INVENTION

1. Field of the Invention

This invention relates to continuous towel cabinets.

2. Prior Art

It is known to provide a continuous towel cabinet having an arrangement of roller means for repeatedly allowing a length of clean towel to be dispensed into a loop beneath the cabinet and for simultaneously rewinding an equivalent length of soiled towel onto a rewind roller.

SUMMARY

According to one aspect of the invention the continuous towel cabinet has a compartment for a roll of clean towel disposed above the arrangement of roller means and having at least a flexible base wall whereby the roll of soiled towel can reduce the depth of the clean towel compartment as the roll of soiled towel increases during operation of the towel cabinet. A very compact design of towel cabinet may thereby be achieved.

Preferably the clean towel compartment is a flexible bag having an aperture extending longitudinally of the bag through which aperture the clean towel is dispensed.

It is also preferred that the bag is detachable from the cabinet, so that on reloading the cabinet, the empty bag and the roll of soiled towel can be removed, and replaced by another bag containing a fresh roll of clean towel.

According to another aspect of the invention the continuous towel cabinet has a cover hinged for upward pivotal movement in addition to a clean towel compartment disposed above the arrangement of roller means, and the arrangement of roller means comprises a front metering roller over which the clean towel is drawn connected in driving relation to a back metering roller acting to rewind the soiled towel onto the rewind roller, and a pressure roller around which the clean towel passes and which maintaining the clean towel in contact with the front metering roller, the pressure roller being carried by the cover whereby the pressure roller is separated from the front metering roller when the cover is raised upwardly for reloading the towel cabinet with a fresh roll of clean towel.

Preferably the towel cabinet includes separate take-up means for retracting the loop at the end of each cycle of operation, the loop take-up means comprising a drive roller driven by a motor. In this case, both metering rollers and the drive roller of the loop take-up means are carried between side walls mounted for forward and then downward pivotal movement when the cover is raised.

It is also preferred that the towel cabinet includes a reservoir for receiving the length of soiled towel withdrawn by the loop take-up means and for storing the towel in a generally vertically extending pile, the soiled towel within the reservoir being subsequently wound onto the rewind roller during the next or succeeding cycles of operation, and the reservoir having a front wall which is also carried between said side walls for pivotal movement therewith.

Preferably the motor for driving the drive roller of the loop take-up means is an electric motor operated by an independent power source, and control means are provided for the motor actuated by sensing means responsive to the rotation of one of the metering rollers when the user pulls on the towel to withdraw a length of clean towel, the sensing means actuating the control means to operate the electric motor after a predetermined time delay.

The sensing means also preferably act as means for measuring the length of clean towel dispensed from the towel cabinet, and for indicating when a predetermined total length of towel has been dispensed for the purpose of signalling that the towel cabinet requires reloading.

According to a further aspect of the invention the continuous towel cabinet has a compartment for a roll of clean towel, and separate take-up means for retracting the loop at the end of each cycle of operation, the loop take-up means comprising a drive roller driven by a motor and a pressure roller which, in use, maintains the clean towel in contact with the drive roller, wherein both the drive roller and the pressure roller of the loop take-up means have at one end a unidirectional clutch bearing which allows the respective roller to rotate in the direction in which soiled towel is withdrawn into the cabinet, the clutch bearing having a housing provided with a projection for engagement with a stop whereby the respective roller can rotate for a maximum of one revolution in the reverse direction, the clutch bearing remaining locked relative to the respective roller. When the user pulls on the towel to create a loop, the roller means permits clean towel to be dispensed. Additionally, a length of soiled towel can be withdrawn between the take-up rollers substantially equivalent to a maximum of one revolution of the take-up rollers thereby increasing the loop by that amount.

According to a still further aspect of the invention the continuous towel cabinet includes stop means for limiting the length of clean towel which can be dispensed during any one cycle of operation, the stop means comprising a member in driving connection with the arrangement of rollers during the dispensing of a length of clean towel for movement between a first stop position and a second stop position, the driving connection being releasable when the dispensing action stops to allow the member to return to its first stop position ready for the succeeding cycle of operation thereby allowing the full permitted length of towel to be dispensed during the succeeding cycle of operation irrespective of the length of towel dispensed during the preceding cycle of operation.

Preferably the arrangement of roller means includes a front metering roller which is rotated by the clean towel being dispensed, the drive connection being between the front metering roller and said member of the stop means, and spring means are provided both for releasing the drive connection and for returning the member to its first stop position.

It is also preferred that the first stop position of said member of the stop means is adjustable whereby the length of clean towel permitted to be dispensed during any one cycle of operation can be varied.

According to yet a further aspect of the invention the arrangement of roller means includes a front metering roller which is rotated by the clean towel being dispensed and the continuous towel cabinet has stop means for limiting the length of clean towel which can be dispensed during one cycle of operation, wherein the front metering roller has a drive coupling relative to the rewind roller whereby the front metering roller can at least partially back rotate with respect to the rewind roller, and the stop means comprises a member in driving connection with the front metering roller during the dispensing of a length of clean towel for movement between a first stop position and a second stop position, the driving connection being releasable when the dispensing action stops in association with back rotation of the front metering roller to allow the stop member to return to its first stop position.

Preferably spring means are provided for both releasing the drive connection between the stop member and the front metering roller and for returning the stop member to its first stop position.

It is also preferred that the drive coupling between the front metering roller and the rewind roller includes a uni-directional clutch which allows free back rotation of the front metering roller with respect to the rewind roller.

DESCRIPTION OF THE PREFERRED EMBODIMENTS

Figure 2:
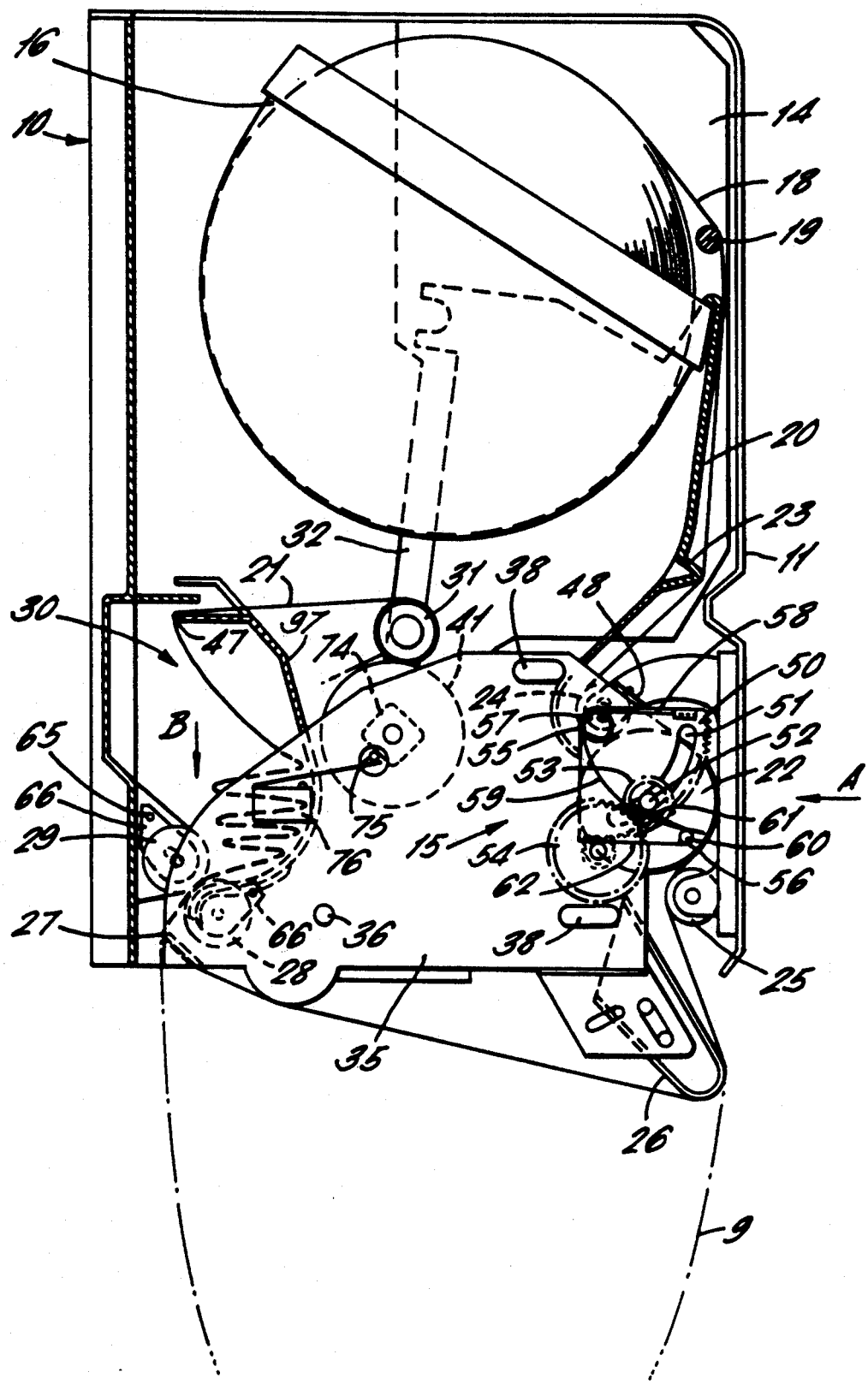
FIG. 2 is a vertical section of the towel cabinet of FIG. 1 showing the path of the towel.
Figure 3:
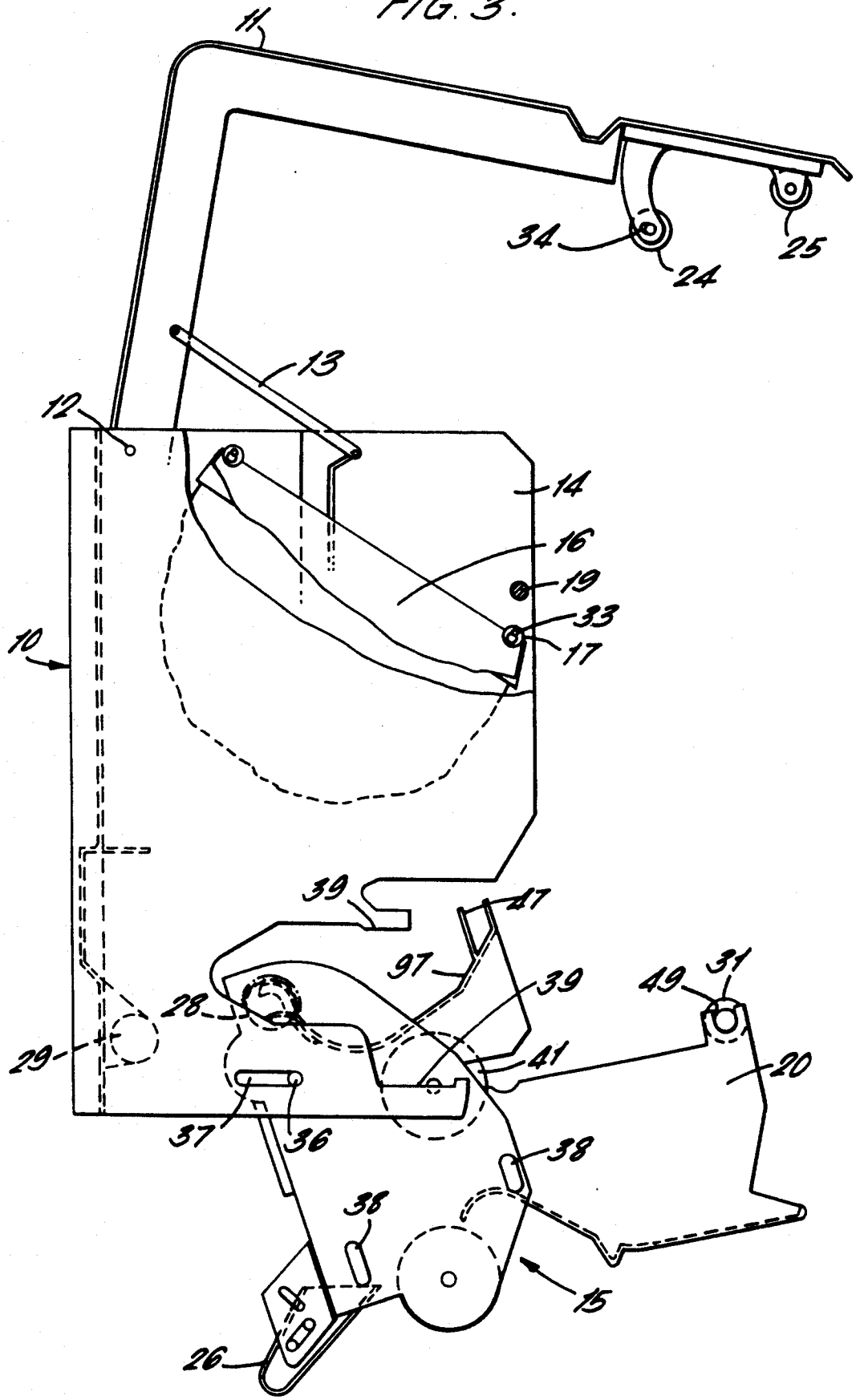
FIG. 3 is an elevation from one side of the towel cabinet of FIG. 1 opened up for reloading with a fresh roll of clean towel, the side of the outer casing being omitted and the rewind roller positioned in slots,for winding thereon the trailing end of the roll of soiled towel.

Referring to the drawings, a continuous towel cabinet comprises a back portion 10 to which a front cover 11 is hinged by pivot pins 12 and supported by side props 13 (FIG. 3). The back portion 10 incorporates two stationary side walls 14 between which is mounted a roller mechanism 15 for pivotal movement between a raised operative position (FIG. 2) and a downward reloading position when the cover 11 is raised (FIG. 3).

Also disposed between the stationary side walls 14, above the roller mechanism 15, is a clean towel compartment having at least a flexible base wall and which, in this embodiment, is in the form of a flexible bag 16. The bag 16 has an open top and at each corner a disc 17 with a key-hole slot for attachment to a peg 33 on the respective side wall 14. The bag is thereby readily detachable from the towel cabinet. The flexibility of the bag allows it to be collapsed and squashed upwardly, in use, as the roll of clean towel reduces and the roll of soiled towel increases. In this embodiment, the bag 16 is formed of nylon fabric with a polyurethane coating to avoid cross-contamination between the clean towel and the soiled towel. As described, during reloading of the cabinet, a roll of clean towel may be inserted into the bag, or a new bag containing a roll of clean towel may be loaded into the cabinet, the used bag being removed with the soiled towel for cleaning and sterlising with the soiled towel. Furthermore, the bag may be a disposable bag intended to be replaced each time the cabinet is reloaded with clean towel.

The roller mechanism 15 is mounted between internal side walls 35 having pivot pins 36 engaging in horizontal slots 37 in the stationary side walls 14 of the cabinet. Each side wall 35 also has a pair of lugs 38. On each side both lugs 38 rest on associated ledges 39 and the lower lug sits behind a stop 40 on the respective stationary side wall 14 thereby holding the mechanism in its raised position. The bottom lugs 38 are lifted over the stops 40 to allow the roller mechanism to be moved forward and then pivoted downwardly into the reloading position. At the upper ends of the side walls 35 are grooves 49 in which during the reloading operation the rewind roller 31 may be supported for rewinding thereon the trailing end of the soiled towel.

In its raised position, the roller mechanism allows clean towel 18 to be dispensed from a roll within the bag into a loop 9 below the cabinet. At the upstream end of the towel path, the clean towel 18 passes over a guide roller 19, then downwardly in front of a plate 20 separating the clean towel from the soiled towel 21, and around a roughened front metering roller 22. The plate 20 has a forwardly extending transverse flange 23 which holds the towel generally spaced from the plate so that the towel does not rub against the full surface of the plate. Mounted on the inside of the cover 11 are a pair of rollers 24, 25 which are held clear of the towel during loading of the cabinet but which hold the towel against the metering roller 22 when the cover is closed. The ends of pressure roller 24 are mounted in slots 34 to give the roller a floating action to allow any join in the towel to pass between the roller 24 and the metering roller 22. In the case of the other guide roller 25, the roller is spaced a small distance from the metering roller 22 in a manner which maintains the towel in contact with the metering roller but which does not require the roller 20 to have a floating action. The towel passes out of the cabinet over a nose portion or blister 26 which allows the user to insert his hands behind the clean towel 18 and to withdraw the towel downwardly to form a loop 9 beneath the cabinet and thereby to dry his hands.

Figure 4:
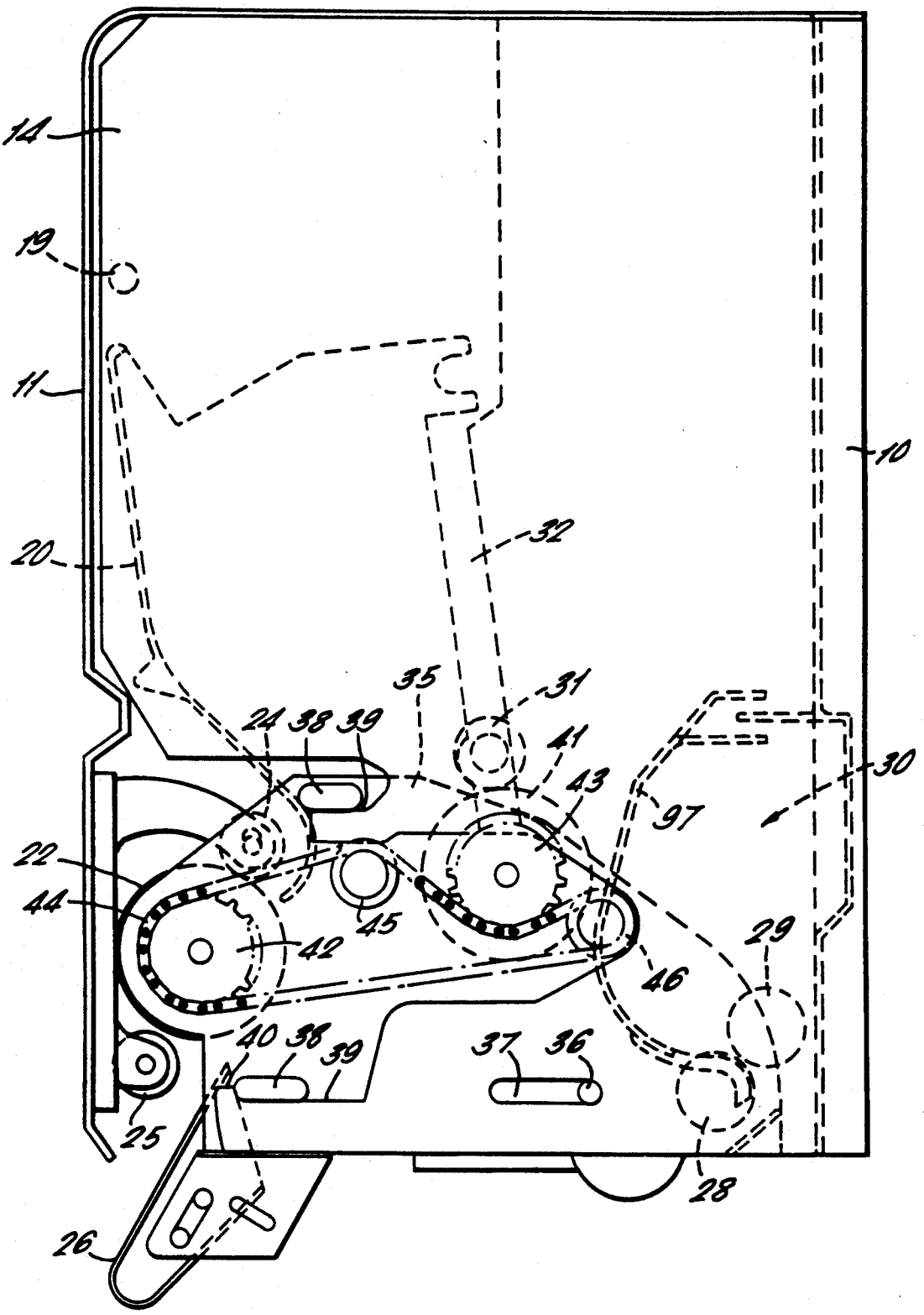
FIG. 4 is an elevation of the towel cabinet of FIG. 1 from the other side, the towel cabinet being closed for dispensing clean towel but the towel being omitted.

The soiled towel 21 is withdrawn into the cabinet over a surface 27 (FIG. 5) by a pair of take-up rollers 28 and 29 (FIG. 2), the towel first being fed into a reservoir portion 30 between the back portion 10 and a front transverse wall 97 carried between the movable side walls 35. The wall 97 is substantially vertical in the raised operative position of the roller mechanism 15. From the top of the reservoir 30, the soiled towel 21 passes onto a rewind roller 31 mounted in generally upwardly extending slots 32 defined between each back edge of the separating plate 20 and a forwardly facing surface of the back portion 10. The rewind roller 31 is driven by a roughened back metering roller 41 through the outermost turn of the towel which has been rewound. The adjacent ends of the shafts of metering rollers 22, 41 have sprockets 42, 43 which are interconnected by a chain drive 44 which also passes over tension pulleys 45, 46 (FIG. 4). The sprockets 42, 43 have the same number of teeth so that the length of soiled towel 21 rewound on the rewind roller 31 is the same as the length of clean towel 18 dispensed at the front of the cabinet. Hence, in operation, when clean towel 18 is dispensed by the user to form a loop 9, an equivalent length of soiled towel 21 is withdrawn from the reservoir 30 and rewound onto the rewind roller 31. As the roll of soiled towel increases in diameter, the rewind roller 31 slides up the slots 32.

Within the reservoir 30 the soiled towel is stored in folded or flaked state. For the purpose of deflaking the towel before it is rewound onto the rewind roller 31, the reservoir is arranged to store the bunched towel in a generally vertically extending pile. Gravity thereby assists to deflake the towel. The towel is also pulled out of the reservoir 30 over the upper edge 47 of the reservoir wall 97 which edge 47 extends into the path of the towel, thereby ensuring that the towel is in a flat state before being rewound.

Figure 6:
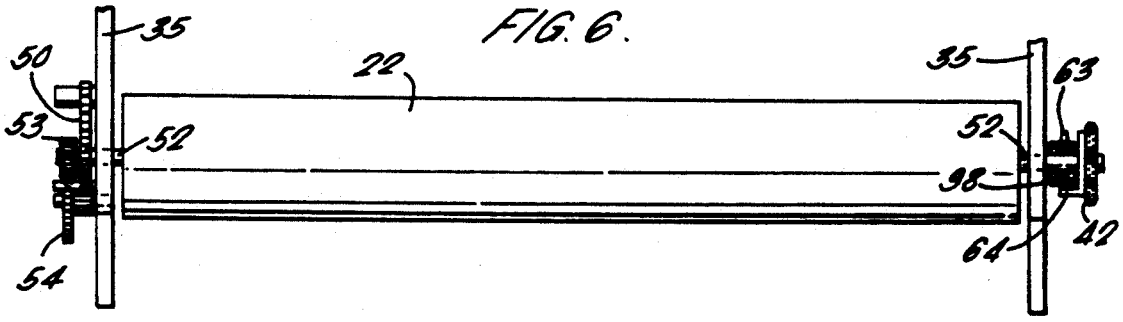
FIG. 6 is an elevation of the front metering roller viewed in the direction of arrow A in FIG. 2.

To limit the length of clean towel 18 which is dispensed at any one time, i.e. for one pull, there is provided a stop device for stopping rotation of the front metering roller 22 in the direction it rotates when the towel is being dispensed, after a given length of the towel has been dispensed. The stop device comprises a pivotally mounted toothed quadrant member 50 (FIGS. 2 and 6) having an arcuate slot 51 engaged by the end of the shaft 52 of the metering roller 22. Also mounted on the shaft 52 is a gear 53 which as it rotates with the roller 22 drives the quadrant 50 through an intermediate compound gear 54. Two coil springs 55, 56 are also provided. The first spring 55 returns the quadrant 50 against a stop 48 at the end of its movement and is mounted on the pivot pin 57 of the quadrant, one end 58 of the spring being attached to the quadrant and the other end 59 resting against the upper surface of a stationary pin 60. The second spring 56 acts to temporarily separate the gear 53 from the larger gear of the compound gear 54 with which it is in contact during the rotation of the metering roller 22 by the towel being dispensed. This second spring 56 is mounted on the stationary pin 60 and has its ends 61, 62 respectively bearing against the undersurface and the top surface of the shafts of the metering roller 22 and the compound gear 54. The temporary separation of the gear 53 and the compound gear 54 by the second spring 56 is required to allow the quadrant 50 to return under pressure of the first spring 55.

Each time the user withdraws a length of clean towel 18, the front metering roller 22 is rotated in a clockwise direction as viewed in FIG. 2, one end driving the back metering roller 41 to rewind an equal length of soiled towel 21 onto the rewind roller 31, and the other end rotating the stop device quadrant 50. At the end of the stroke of the quadrant a predetermined length of towel will have been withdrawn thereby forming a loop 9. The quadrant 50 will then return to its initial position against the stop 48. The position of the stop 48 is adjustable by means of a screw and a slot whereby the stroke of the quadrant 50 can be varied. Moreover, in any one cycle, even if the full amount of clean towel permitted to be withdrawn by the particular adjustment of the quadrant 50 is not withdrawn by the user, the quadrant will nevertheless return to its initial position against the stop 48 and allow the full amount to be withdrawn in the subsequent cycle.

The above-mentioned temporary separation of the gears 53, 54, after a length of clean towel has been dispensed, allows the stop device to cancel, whereupon another length of clean towel may be dispensed. The efficiency of the gears 53, 54 to release after the towel has been pulled is dependent on a partial back rotation of the front metering roller 22 resultant from a reaction caused by forward rotation of the front metering roller 22, when the clean towel is released. To permit the required back rotation in a manner which is unencumbered by the load of the roll of soiled towel and the chain drive 44, there is provided a drive coupling between the shaft of the front met®ring roller 22 and the sprocket 42. In particular the sprocket 42 is freely mounted on the shaft 52 of the front metering roller 22 and the drive coupling comprises a pin 63 attached to the shaft 52 ,which,. engages a face 64 on the boss of the sprocket 42. In normal use rotation of the front metering roller 22 by a pull on the clean towel will rotate the sprocket 42 via the drive coupling 63, 64, and the sprocket will in turn sychronise the chain drive 44 to rotate the rear metering roller 41 and via the soiled towel the rewind roller 31. At the end of the pull on the clean towel, the front metering roller 22 is able to partially back rotate independently of the sprocket 42.

However, it has been found that a problem can arise if the pin 63 of the drive coupling is rigidly fixed on the shaft 52. In operation when the clean towel is pulled, the stop device limits the length of clean towel dispensed. At the same time the soiled towel roll, the chain drive 44 and the rear metering roller 41 have inertia and are not controlled by the stop device, and therefore continue to rotate until the friction in the mechanism overcomes the movement. The result is that a greater length of towel is re-rolled than is dispensed, thereby causing an undesirable shortening of the loop 9 beneath the cabinet.

To compensate for this tendency for the towel loop 9 to shorten, the drive coupling 63, 64 allows the front metering roller 22, during the next cycle, to rotate part or nearly one full revolution before the pin 63 engages the drive face 64 and thereby engaging the chain drive 44. Such initial rotation of the front metering roller 22 before the engagement of the drive transmission means that a short additional length of clean towel is dispensed and thus has the effect of restoring the towel loop 9 to its intended length.

From time to time during use of the cabinet, and particularly when the clean towel is pulled with excess force and the roll of soiled towel is nearing its full condition, the above-mentioned inertia in the drive transmission and the soiled towel is at its greatest. It has been found that, with the stop device engaged, the uncontrolled rotating part of the mechanism permits the sprocket 42 on the shaft 52 of the front metering roller 22 to rotate one full revolution relative to the front metering roller which results in the face 64 making contact with the reverse side of the drive pin 63 attached to the shaft 52 which is then stationary. When the clean towel is released, the stop device, under normal conditions, would cancel because of the temporary separation of the gears 53 and 54 by the spring 56 and the back rotation of the front metering roller 22. However, under the condition just described the front metering roller 22 would be unable to back rotate because such movement would be prevented by the face 64 on the sprocket 42 making contact with the reverse side of the pin 63, thereby effectively jamming the stop device.

To eliminate this problem, the pin 63 is attached to the housing of a uni-directional clutch 98 mounted on the shaft 52 of the front metering roller 22. The clutch 98 provides a positive drive connection, when the clean towel is pulled, between the shaft 52 and the pin 63, but permits the front metering roller 22 to freely back rotate relative to the pin 63. Thereby, irrespective of the relative positions of the pin 63 and the face 64 of the sprocket 42, the front metering roller 22 is able to back rotate to allow the stop device to cancel, and thus eliminate the possibility of jamming.

Figure 9:
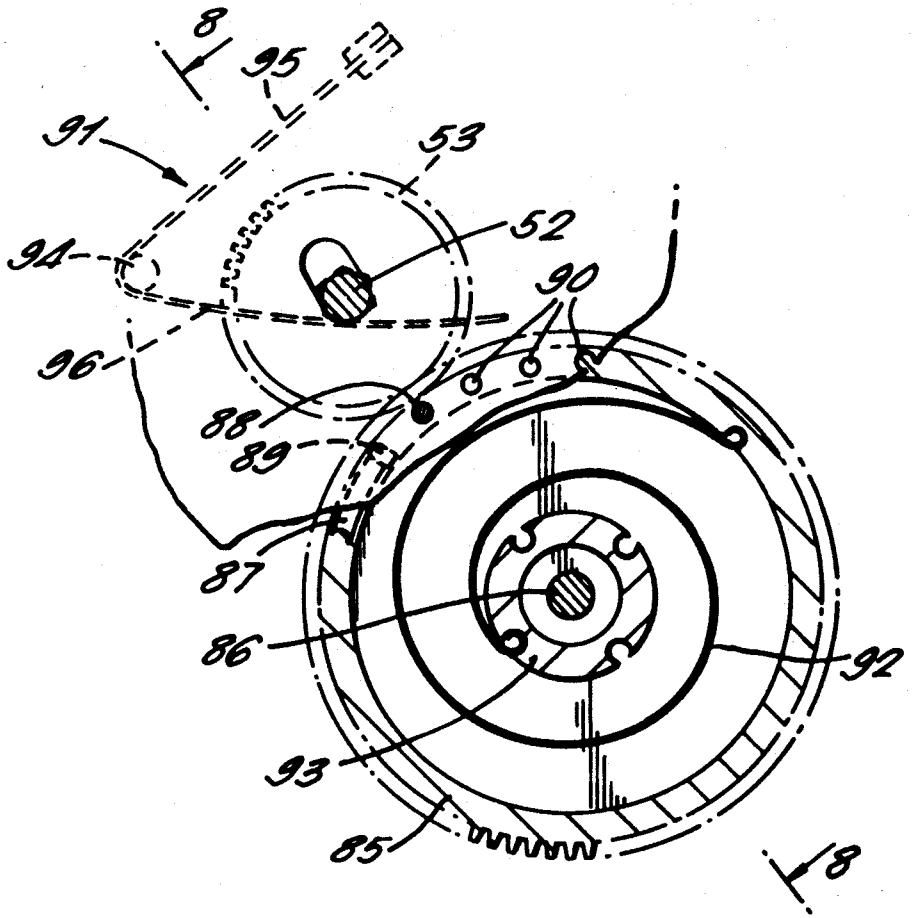
FIG. 9 is a section along line 9—9 in FIG. 8.
Figure 8:
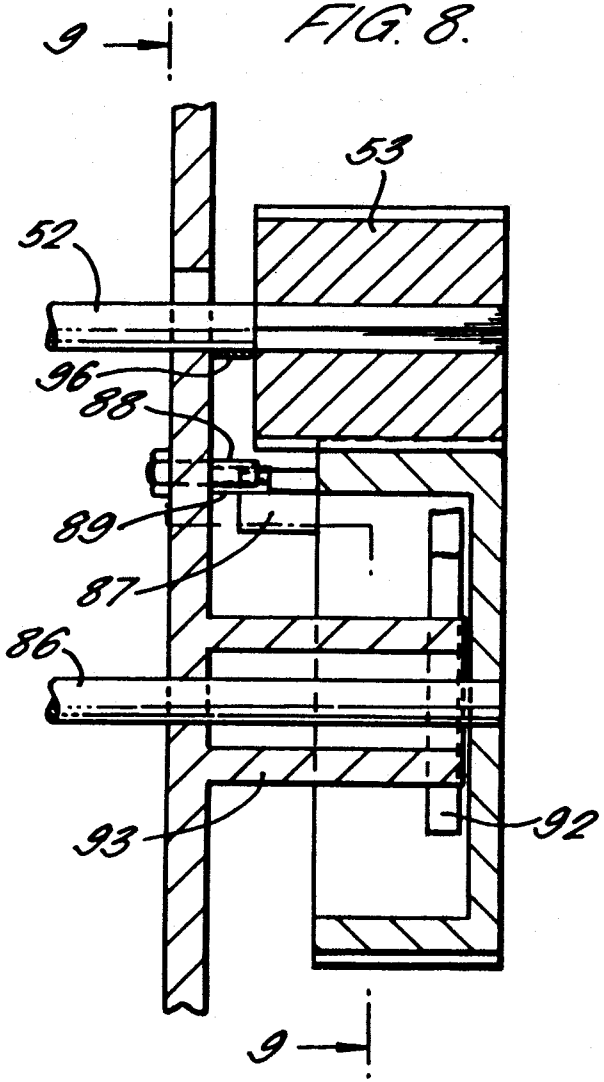
FIG. 8 illustrates a sectional view of an alternative stop device for limiting the length of clean towel which is dispensed for each pull on the towel.

FIGS. 8 and 9 show an alternative stop device which operates in the same manner as the previous stop device and comprises a hollow gear wheel 85 whose teeth are in driving connection with the gear 53 on the shaft 52 of the front metering roller 22. In the present case, the shaft 52 is hexagonal to preclude relative rotation between the gear 53 and the shaft. The gear wheel 85 is mounted for rotation on a pin 86 projecting outwardly from the adjacent side wall 35. Also, on its inner edge, the gear wheel 85 has an integral projection 87 which reciprocates with the gear wheel between two stops 88, 89 of which stop 88 is mounted in any one of a series of holes 90 to provide for adjustment of the stroke of the stop device. Stop 89 is a fixed stop. As in the previously described stop device, a pair of springs are provided, spring 91 acting to temporarily disengage the drive connection between the gear 53 and the gear wheel 85 when the stop device has completed its stroke, to enable spring 92 to return the gear wheel 85 and its projection 87 to its start position with the projection resting against the adjustable stop 88. Downward pressure on the front metering roller 22 by the user, via the towel, reengages the drive connection. The spring 91 is mounted on pin 94 and has two arms 95,,96, the arm 95 being fixed and the other arm 96 engaging the underside of the shaft 52 between the gear 53 and the side wall 35. The other spring 92 is a coil spring mounted within the hollow gear wheel 85 with one end held captive on the inner periphery of the gear wheel and its other end held captive by a fixed hub 93 surrounding the pin 86 on which the gear wheel 85 is mounted.

If required, in each embodiment, the user may pull on the clean towel 18 more than once to withdraw sufficient clean towel to form the necessary loop 9 to dry his hands. However, as described below, it is preferred that it should be arranged for one pull to be sufficient. After a predetermined time, the loop is retracted until the towel passes tightly beneath the cabinet, the length of towel which is taken up being withdrawn by the rollers 28, 29 into the reservoir 30. For this purpose, the upper roller 29 is a pressure roller mounted in end slots so that under its own weight it applies a constant pressure on the towel acting to tension the towel. However, the slots allow substantial vertical movement of the roller 29 relative to the towel, if necessary, in case the towel should temporarily crease or contain joins. The lower roller 28 is a drive roller which is mounted between the pivoted side walls 35. When the roller mechanism 15 is lowered, the drive roller 28 is thereby separated from the pressure roller 29 to provide a wide gap therebetween through which the leading end of a fresh roll of towel may be threaded before being manually wound onto the rewind roller 31. Each roller 28, 29 has a series of circumferential grooves along its length for locating stripping members 66 which prevent the towel from wrapping itself around the respective roller instead of passing into the reservoir 30. In this embodiment, each stripping member 66 is a generally triangular shaped plate which loosely surrounds the roller within the respective groove and is carried by a common mounting rod 65 for the stripping members of that roller. The stripping members thus float during rotation of the rollers 28, 29.

Figure 5:
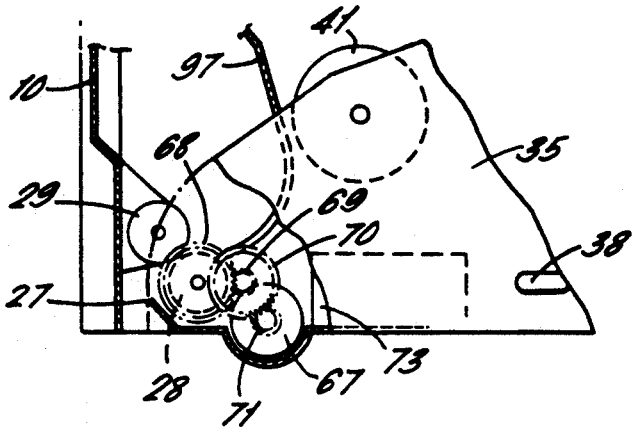
FIG. 5 is an end view of the loop take-up means and the drive means thereto.
Figure 7:
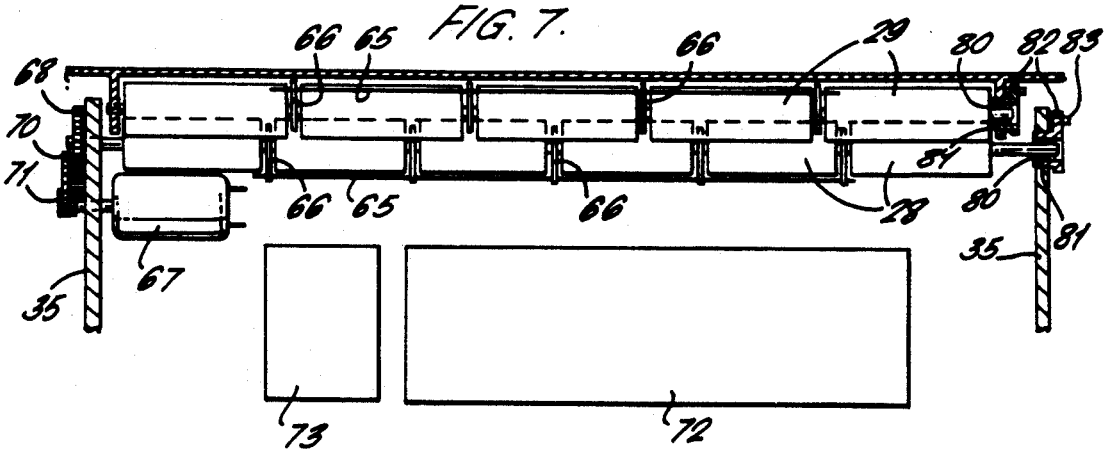
FIG. 7 shows the loop take-up means viewed in the direction of arrow B in FIG. 2.

The drive to the roller 28 is a gear train from an electric motor 67 (FIGS. 5 and 7). On one end of the roller 28 is a gear wheel 68 which is engaged by the smaller gear 69 of a compound gear. The larger gear 70 of the compound gear is driven by a further gear wheel 71 mounted on the shaft of the motor 67.

On the other end of the drive roller 28, and on the adjacent end of the pressure roller 29 is a unidirectional clutch bearing 80. In respect of each roller 28, 29 the clutch bearing is a needle clutch bearing which allows the respective roller to be rotated in the direction to drive the towel into the reservoir 30, but is engaged if a torque is applied in the reverse direction, i.e. if the user pulls the towel back. The use of such a unidirectional clutch to prevent soiled towel being withdrawn from the cabinet is known. However, in the present embodiment, it is desired to permit the withdrawal of a limited length of soiled towel thereby allowing a controlled lengthening of the loop beneath the cabinet whilst still generally precluding the withdrawal of soiled towel. For this purpose the housing 81 of each clutch bearing 80 is rotatable in the reverse direction for a maximum of one revolution of the respective roller 28, 29 until a projection 82 extending outwardly from the housing engages a stop 83 on the mounting member for the roller. During the back rotation of the rollers 28, 29, each clutch bearing remains locked relative to its respective roller, and when each projection 82 is in engagement with its respective stop 82, not further soiled towel can be withdrawn into the loop.

Figure 1:
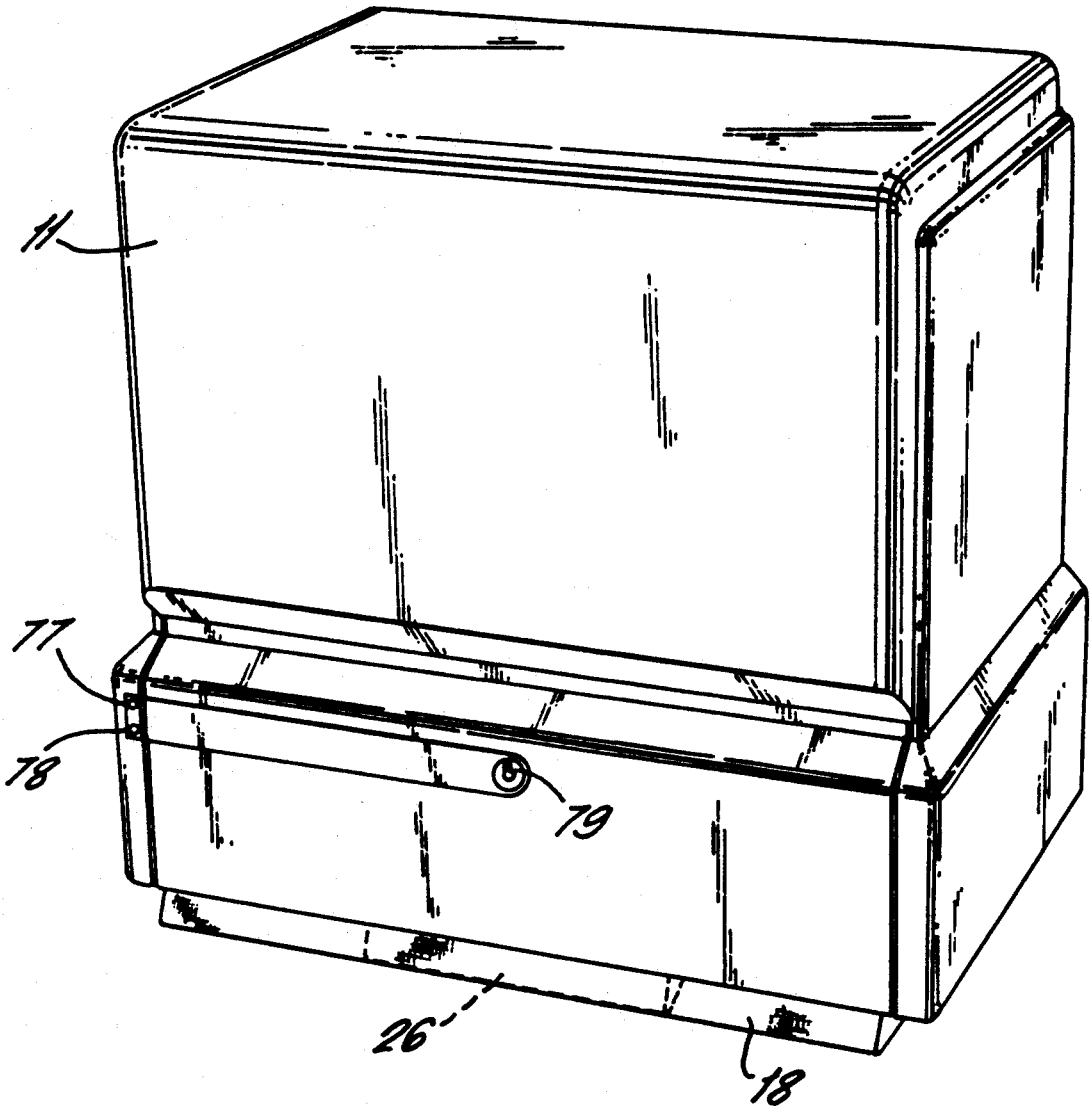
FIG. 1 is a perspective view, by way of example, of a continuous towel cabinet.

The drive motor 67 for the roller 28 is an electric motor operated from an independent low power DC energy source which in this embodiment is a plurality of alkaline batteries 72 disposed within the cabinet. An indicator light 77 (FIG. 1) is operated when the battery power reaches a minimum safe level, and thereby indicates that the batteries require to be replaced.

The digital control means 73 for the electric motor 67 is an integrated circuit which, in this embodiment is made operative, in that it senses a voltage, by the user withdrawing clean towel to form a loop 9 beneath the cabinet. Such action rotates the front metering roller 22 and via the chain drive 44 the rear metering roller 41. On the opposite end of the rear metering roller 41 from the chain drive is a four faced cam 74 which is engaged by a pin 75 on a micro-switch 76. Closing the micro-switch 76 actuates the electric motor 67. It will thus be appreciated that for each revolution of the rear metering roller 41, the micro-switch 76 will be opened and closed four times. By this means the micro-switch operates a counter which is employed to measure the length of soiled towel rewound and thereby indicate by, in this embodiment, a flashing light 78 (FIG. 1) that the towel is nearly finished and the cabinet requires reloading with a fresh roll of clean towel. In this embodiment a count of 800 pulses of the micro-switch or 200 revolutions of the metering rollers 22, 41 is effective to operate the light 78. When the towel is rewound, the light is switched off and the counter reactivated to start again for the fresh roll.

The control circuit includes a time delay so that after the motor 67 is activated it will not be operated for a period which, in this embodiment, is 14 seconds. The motor will then operate the drive roller 28 of the take-up means for a set period of, in this embodiment, 4.5 seconds which is intended to be sufficient to withdraw the loop 9 of towel. However, in case it is not because, for example, the user is still drying his hands, the motor will be operated for a second period of 4.5 seconds after a further time delay, and is then switched off.

In operation, the towel cabinet is loaded by raising t he cover 11 which is normally held closed by a key operated lock 79, and then lowering the roller mechanism 15. A fresh roll of clean towel is inserted into the bag 16. The leading end of clean towel is withdrawn from the bag and passed over the guide roller 19 and in front of the metering roller 22. The towel end is then threaded through the gap between the take-up rollers 28, 29 and wrapped around the rewind roller 31. The roller mechanism 15 is then raised and the cover 11 shut. Pulling on the towel beneath the cabinet will activate the motor 67 to take up the loop of towel, after the predetermined time delay and release of the towel. The cabinet is then ready for operation.

Each time a user withdraws clean towel 18 a loop of towel is formed beneath the cabinet. In the present embodiment, the loop 9 is capable of being formed at the front by a length of clean towel determined by the stop device and at the back by a length of soiled towel substantially equivalent to one revolution of the take-up rollers 28, 29, thereby achieving a sufficient length of loop for the user, for one downward pull on the towel. However, if desired, the loop can be further extended by more than one pull to dispense additional clean towel. When the towel is released by the user, and after the predetermined time delay, the loop is withdrawn into the reservoir 30 and then during the next or subsequent cycles the soiled towel 21 is rewound onto the rewind roller 31. When the indicator light 78 flashes, the towel requires changing. The cabinet is then opened. The soiled towel is removed and the cabinet reloaded with a fresh roll of clean towel.

The invention is not restricted to the details of the specific embodiment described above. For example, instead of loading the roll of clean towel into a detachable bag 16, there may be provided a permanent clean towel compartment having at least a flexible membrane or sheet as a base wall. Thereby the soiled towel compartment can still expand upwardly as the roll of soiled towel increases, to reduce the depth of the clean towel compartment, and maintain the compactness of the towel cabinet.

Also, although in the above described embodiment the loop 9 is withdrawn at the end of each cycle of operation, the invention is equally applicable to a continuous towel cabinet in which the loop is not withdrawn and a loop of towel is maintained permanently beneath the cabinet until all the clean towel has been dispensed. The electric motor is then operated to withdraw the trailing end of the towel into the reservoir 30.

Furthermore, the chain drive 44 may be replaced by a gear train interconnecting gear wheels on the respective ends of the shafts of the front and back metering rollers 22, 41. The gear wheel on the shaft of the front metering roller 22 replaces the sprocket 42 and likewise is freely mounted thereon whereby the drive transmitting pins 63, 64 allow back rotation of the front metering roller subsequent to the separation of the drive connection at the other end of the front metering roller.

We claim:

1. A cabinet for dispensing continuous towel from a roll of clean towel to a loop beneath the cabinet and for rewinding soiled towel from said loop onto a rewind roller to form a roll of soiled towel, said cabinet comprising:

a compartment for a roll of clean towel, and an arrangement of roller means for repeatedly allowing a length of clean towel to be dispensed into a loop beneath the cabinet and for simultaneously rewinding an equivalent length of soiled towel onto said rewind roller, said compartment including a clean towel holder for holding a roll of clean towel, said holder having a flexible base wall which provides a means for allowing the holder to collapse progressive from below by the roll of soiled towel as it increases in size, and means within the cabinet for suspending the clean towel holder at a position above the arrangement of roller means.

2. A continuous cabinet as claimed in claim 1, wherein the clean towel holder is a flexible bag having an open top through which clean towel is dispensed.

3. A continuous towel cabinet as claimed in claim 2, wherein the means for suspending the clean towel holder is constructed and arranged so that the bag is detachable from the cabinet, so that on reloading the cabinet, the bag and the roll of soiled towel can be removed, and replaced by another bag containing a fresh roll of clean towel.

4. A cabinet for dispensing continuous towel from a roll of clean towel to a loop beneath the cabinet and for rewinding soiled towel from said loop onto a rewind roller to form a roll of soiled towel, said cabinet comprising:

a cover hinged for upward pivotal movement to a raised position for reloading the towel cabinet with a fresh roll of clean towel, a compartment for a roll of clean towel, and an arrangement of roller means for repeatedly allowing a length of clean towel to be dispensed into a loop beneath the cabinet and for simultaneously rewinding an equivalent length of soiled towel and said rewind roller, wherein the clean towel compartment is disposed above the arrangement of roller means, and the arrangement of roller means comprises a front metering roller over which clean towel is drawn, a back metering roller connected in driving relation to the front metering roller and being operable to rewind soiled towel onto the rewind roller, and a pressure roller around which clean towel passes and which maintains clean towel in contact with the front metering roller, the pressure roller being carried by and movable with the cover from an operative position where it contacts clean towel on the front metering roller to an inoperative position where the pressure roller is separated from the front metering roller when the dover is raised upwardly for reloading the towel cabinet with a fresh roll of clean towel.

5. A continuous towel cabinet as claimed in claim 4, including separate take-up means for retracting the loop at an end of each dispensing cycle, the loop take-up means comprising a drive roller driven by a motor, side walls which carry both metering rollers and the drive roller of the loop take-up means said side walls being mounted for forward and then downward pivotal movement when the cover is raised.

6. A continuous towel cabinet as claimed in claim 5, including a reservoir for receiving withdrawn by the take-up means and for storing it in a generally vertically extending pile, soiled towel within the reservoir being subsequently wound onto the rewind roller during the next or succeeding cycles of operation, and the reservoir having a front wall which is also carried between said side walls for pivotal movement therewith.

7. A continuous towel cabinet as claimed in claim 5, wherein the motor for driving the drive roller of the loop take-up means is an electric motor operated by an independent power source, and sensing means responsive to the rotation of one of the metering rollers when a user pulls to withdraw a length of clean towel, and control means actuated by the sensing means to operate the electric motor after a predetermined time delay.

8. A continuous towel cabinet as claimed in claim 7, wherein the sensing means also act as means for measuring the length of clean towel dispensed from the towel cabinet, and for indicating when a predetermined total length of towel has been dispensed for the purpose of signalling that the towel cabinet requires reloading.

9. A cabinet for dispensing continuous towel from a roll of clean towel to a loop beneath the cabinet and for rewinding soiled towel from said loop onto a rewind roller to form a roll of soiled towel, said cabinet comprising:

a compartment for a roll of clean towel, an arrangement of roller means for repeatedly allowing a length of clean towel to be dispensed into a loop beneath the cabinet and for simultaneously rewinding an equivalent length of soiled towel onto a rewind roller, and separate take-up means for retracting the loop at an end of each cycle of operation, loop take-up means comprising a drive roller, a motor for driving the drive roller, and a pressure roller which maintains clean towel in contact with the drive roller, wherein the drive roller and the pressure roller of the loop take-up means each have at one end a unidirectional clutch bearing which allows the respective roller to rotate in a forward direction which withdraws soiled towel from said loop into the cabinet, the clutch bearing each having a housing provided with a projection, and stop means which are engageable by said projections for allowing the respective roller to rotate for a maximum of one revolution in a reverse direction which is opposite to said forward direction before the clutch bearing becomes locked relative to its respective roller.

10. A cabinet for dispensing continuous towel from a roll of clean towel to a loop beneath the cabinet and for rewinding soiled towel from said loop onto a rewind roller to form a roll of soiled towel, said cabinet comprising:

an arrangement of roller means repeatedly allowing a length of clean towel to be dispensed into a loop beneath the cabinet and for simultaneously, rewinding an equivalent length of soiled towel onto said rewind roller, and stop means for limiting the length of clean towel which can be dispensed to said loop during any one cycle of operation, wherein the stop means comprises a member having a driving connection with the arrangement of rollers during the dispensing of a length of clean towel, said member being movable between a first stop position and a second stop position, the driving connection being releasable when the dispensing action stops, and means for returning the member to its first stop position ready for the succeeding cycle of operation thereby allowing the full permitted length of towel to be dispensed during a succeeding cycle of operation irrespective of the length of towel dispensed during the preceding cycle of operation.

11. A continuous towel cabinet as claimed in claim 10, wherein the arrangement of roller means includes a front metering roller which is rotated by the clean towel being dispensed, the driving connection being between the front metering roller and said member of the stop means, and spring means are provided both for releasing the driving connection and for returning the member to its first stop position.

12. A continuous towel cabinet as claimed in claim 10, wherein the first stop position of said member of the stop means is adjustable whereby the length of clean towel permitted to be dispensed during any one cycle of operation can be varied.

13. A cabinet for dispensing continuous towel from a roll of clean towel to a loop beneath the cabinet and for rewinding soiled towel from said loop onto a rewind roller to form a roll of soiled towel, said cabinet comprising:

an arrangement of rollers including a front metering roller which is rotated by clean towel being dispensed, and stop means for limiting the length of clean towel which can be dispensed to said loop during one cycle of operation, a drive coupling connecting the rewind roller, providing means for permitting the front metering roller to at least partially back rotate with respect to the rewind roller, and the stop means includes a member having a driving connection with the front metering roller during the dispensing of a length of clean towel, said member being movable between a first stop position and a second stop position, the driving connection being releasable when the dispensing action stops in association with back rotation of the front metering roller and means for returning the stop member to its first stop position.

14. A continuous towel cabinet as claimed in claim 13, wherein spring means are provided for both releasing the driving connection between the stop member and the front metering roller and for returning the stop member to its first stop position.

15. A continuous towel cabinet as claimed in claim 13, wherein the drive coupling between the front metering roller and the rewind roller includes a uni-directional clutch which allows free back rotation of the front metering roller with respect to the rewind roller.

* * * * *